US007453152B2

(12) United States Patent
Ramarajan

(10) Patent No.: US 7,453,152 B2
(45) Date of Patent: Nov. 18, 2008

(54) DEVICE HAVING REDUCED CHEMICAL MECHANICAL PLANARIZATION

(75) Inventor: Suresh Ramarajan, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 121 days.

(21) Appl. No.: 11/475,585

(22) Filed: Jun. 27, 2006

(65) Prior Publication Data

US 2006/0240221 A1 Oct. 26, 2006

Related U.S. Application Data

(63) Continuation of application No. 10/750,734, filed on Dec. 31, 2003, now abandoned.

(51) Int. Cl.
*H01L 23/48* (2006.01)
*H01L 21/4763* (2006.01)

(52) U.S. Cl. ..... 257/774; 257/758; 257/E21.583; 438/633

(58) Field of Classification Search ..... 257/774, 257/758, E21.583; 438/633
See application file for complete search history.

(56) References Cited

U.S. PATENT DOCUMENTS

| | | | | |
|---|---|---|---|---|
| 5,552,638 | A * | 9/1996 | O'Connor et al. | 257/759 |
| 6,001,730 | A * | 12/1999 | Farkas et al. | 438/627 |
| 6,649,523 | B2 * | 11/2003 | Basol et al. | 438/692 |
| 6,702,954 | B1 | 3/2004 | Her et al. | |
| 2003/0020141 | A1 * | 1/2003 | Thomas | 257/620 |
| 2005/0074967 | A1 * | 4/2005 | Kondo et al. | 438/630 |
| 2005/0085066 | A1 * | 4/2005 | Tsao et al. | 438/633 |

* cited by examiner

*Primary Examiner*—Nitin Parekh
(74) *Attorney, Agent, or Firm*—Fletcher Yoder

(57) ABSTRACT

The present technique is directed toward the fabrication of integrated circuits and provides for the production of a hardened metal layer on the surface of a semiconductor wafer to reduce the amount of material removed during chemical mechanical planarization (CMP) of the metal layer. This hardened layer may be produced, for example, by oxidizing the metal surface and/or coating the metal surface with a polymer. In one implementation, a relatively thick and dense oxide layer is formed on the wafer metal surface prior to CMP, by injecting, for example, an oxidant, such as oxygen or ozone, near the end of an annealing cycle. The hardened metal beneficially protects recessed regions from CMP chemical attack and CMP pad deformation, and thus reduces the thickness-to-planarity, dishing, and waste generation realized during CMP.

15 Claims, 4 Drawing Sheets

DEVICE HAVING REDUCED CHEMICAL MECHANICAL PLANARIZATION

CROSS-REFERENCE TO RELATED APPLICATION

This application is a continuation of U.S. patent application Ser. No. 10/750,734, which was filed on Dec. 31, 2003 now abandoned.

BACKGROUND OF THE INVENTION

1. Field of the Invention

The present invention relates generally to improving the fabrication of integrated circuits and, more particularly, to reducing thickness-to-planarity and dishing during chemical mechanical planarization of layers on a substrate.

2. Description of the Related Art

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Microprocessors and memory devices, such as dynamic and static random access memories (DRAM and SRAM), are complex integrated circuits that are used in a wide variety of applications throughout the world. Such applications include personal computers, control systems, telephone networks, and a host of other consumer products. Despite their complexity, price competition requires that microprocessor and memory designs be inexpensive to manufacture. In the fabrication of integrated circuits, it can be a significant cost advantage to reduce the amount of material used and the waste generated.

Integrated circuits, such as random access memories, are fabricated on semiconductor wafers. They may be mass produced by fabricating thousands of identical circuit patterns on a single semiconductor wafer and subsequently dividing them into identical dies or chips. Integrated circuits are commonly referred to as "semiconductor devices" because the wafer substrates are typically a semiconductor, such as silicon. Integrated circuits are fabricated, however, by depositing numerous materials of varying electrical properties on the semiconductor wafer. These materials include insulators or dielectrics (such as silicon dioxide), conductors (such as polysilicon, copper, aluminum and tungsten), and semiconductors (such as silicon and germanium).

To produce the integrated circuit, many commonly known processes are used to modify, remove, and deposit the materials onto the semiconductor wafer. Processes such as ion implantation, sputtering, etching, chemical vapor deposition and variations thereof, such as plasma enhanced chemical vapor deposition, are among those commonly used. These steps of material deposition or removal on a semiconductor wafer are frequently followed by a planarization step such as chemical mechanical planarization (CMP).

Generally speaking, planarization is a process of removing material to render a surface relatively smooth. CMP, in particular, is the process of smoothing and planarizing aided by chemical and mechanical forces. The CMP process helps to minimize barriers to multilayer formation and metallization, as well as to smooth, flatten, and clean the surface. This process involves chemically modifying the surface while also mechanically polishing it. The combined action of surface chemical reaction and mechanical polishing allows for controlled layer-by-layer removal of the desired material from the wafer surface, resulting in the preferential removal of protruding surface topography and producing a planarized wafer surface. The degree of planarization may be measured, for example, with an optical reflectivity sensor. In the past few years, CMP has become one of the most effective techniques for planarizing a semiconductor wafer.

In general, the CMP process involves holding a semiconductor substrate, such as a wafer, against a rotating wetted polishing pad under controlled downward pressure. Alternately, the CMP process may involve holding a wetted polishing pad while rotating a semiconductor substrate, such as a wafer, under controlled downward pressure. A polishing slurry delivered onto the polishing pad contains etchants and an abrasive material such as alumina or silica. A wafer carrier is typically utilized to hold the wafer under controlled pressure against the polishing pad. The polishing pad may be constructed, for example, of a felt fabric material impregnated with blown polyurethane. To summarize, the three key elements in the CMP process include the surface to be polished, the pad which enables the transfer of mechanical forces to the surface being polished, and the slurry which provides both chemical and mechanical effects.

Abrasive particles in the slurry cause mechanical alteration at the sample surface, loosening the material for enhanced chemical attack or fracturing off the pieces of surface into a slurry where they dissolve or are swept away. For efficient planarization, it is typically desirable to enhance material removal rate from elevated regions or high points on the surface and to reduce material removal in recessed regions. Moreover, it is the combination of chemical and mechanical effects, and not these forces alone, that is typically advantageous. For example, chemistry alone typically will not achieve planarization because most chemical actions are isotropic. Mechanical grinding alone theoretically may achieve the desired planarization but is generally not desirable because of the extensive associated damage of the material surfaces.

To reduce the amount of material removed during CMP and thus the amount of material that must be deposited prior to CMP, it is typically preferred in CMP to remove material only from elevated regions on the sample surface. By removing material primarily from high points on the surface to achieve the specified degree of planarization, the amount of material removed, the related thickness-to-planarity, and the associated dishing phenomenon (discussed below) may be reduced. A problem in CMP, however, is that material is undesirably removed from recessed regions, increasing thickness-to-planarity and dishing. For example, during CMP the pad may deform and grind the recessed regions. As a result, in order to reach planarization, more material must be added initially to the wafer to account for the more material that is being removed from the recessed regions during CMP. Furthermore, even where the pad does not touch the recessed regions, the CMP slurry may etch material in the recessed regions. Again, more material must be removed to achieve planarity. More waste is generated and more material must be deposited initially to accommodate the significant amount of material removed during CMP.

Additionally, dishing, an undesirable effect occurs in filled contact openings. The recessed surface of the filled contact opening ("contact plug") may be attacked by the slurry. Material is dissolved below the CMP stopping layer, forming a dish-shaped cavity on the wafer surface. Dishing may be characterized as the distance between the CMP stopping layer on the field and the contact plug surface. Significant material removal may occur in the recessed contact plug.

For metals, efforts to reduce dishing and thickness-to-planarity include the use of CMP slurries that not only dissolve the metal layer but also oxidize the metal surface or coat the metal surface with a polymer during CMP. Mechanical action removes the oxide or the polymer layer from the elevated regions (due to the higher pressure experienced), exposing the underlying metal to the slurry that can dissolve the metal, while the oxide or the polymer coating in the recessed areas may stay intact protecting the metal from the slurry.

For slurries that oxidize, a drawback is that the oxide layer formed on the metal surface is thin and relatively sparse, and hence, easily removed in the recessed regions due to CMP pad deformation. As a result, dishing and the thickness-to-planarity remain relatively high. For slurries that form polymers on the metal surface, the polymeric coating may protect the recessed areas better than a thin oxide layer but the coating is difficult to remove. Removal of a polymeric coating typically requires, for example, that the wafer be heated to a high temperature such as 100° C. Moreover, whether the slurry oxidizes the metal surface or coats the metal surface with polymer, these slurries are relatively expensive and do not significantly reduce thickness-to-planarity or dishing.

Other efforts to improve dishing characteristics involve the use of a harder CMP pad that deforms less than the typical CMP softer pads. Harder pads, however, can scratch wafers. Also, as will be appreciated by those of ordinary skill in the art, it is difficult to condition harder pads. For example, the use of a typical diamond-based conditioner may not effectively remove damaged portions of harder pads.

The present invention may be directed to one or more of the problems set forth above.

BRIEF DESCRIPTION OF THE DRAWINGS

Advantages of the invention may become apparent upon reading the following detailed description and upon reference to the drawings in which.

DETAILED DESCRIPTION OF SPECIFIC EMBODIMENTS

Figure 1:
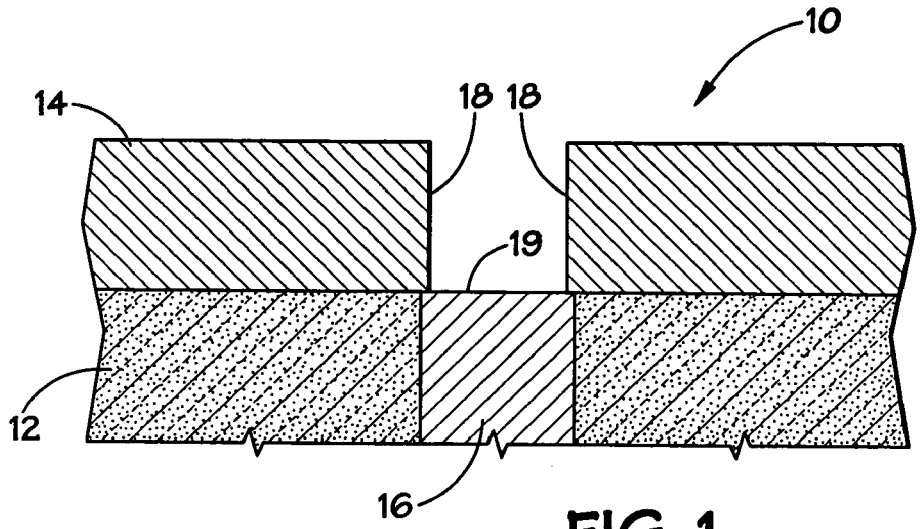
FIG. 1 illustrates a cross-sectional view of an exemplary semiconductor wafer having a contact opening etched in an ILD layer.

One or more specific embodiments of the present invention will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

To reduce the amount of material removed during chemical mechanical planarization (CMP) of metal layers on semiconductor wafers, embodiments of the present technique hardens (modifies) the surface of the metal layers prior to CMP. Such hardening before CMP may be accomplished, for example, by oxidizing the metal surface or by coating the metal surface with a polymer. In general, the surface of the metal layer is hardened to increase its resistance to abrasion and/or chemical attack. Accordingly, less material is removed from recessed regions during CMP because the hardened surface makes the recessed regions less susceptible to abrasion caused by undesirable CMP pad deformation and/or less susceptible to etching caused by undesirable chemical attack by the CMP slurry. As discussed more below, hardening of the metal layer before CMP reduces dishing and thickness-to-planarity realized during the subsequent CMP of the wafer and metal layer. It should be noted that a "hardened" surface may be defined broadly to include both resistance to abrasion and resistance to chemical attack. In other words, even if the surface metal layer surface is softened in the traditional sense, for example, by coating with a soft polymer to increase chemical resistance, the surface is "hardened" as defined here.

Nevertheless, in one embodiment, the surface of the wafer metal layer is oxidized prior to CMP, such as during an annealing process. For a metal layer comprising copper, the oxidation forms a copper oxide film on the surface. As a result, the amount of copper removed during the subsequent CMP is reduced. It should be restated, however, that though oxidation is extensively discussed, the present technique encompasses approaches other than oxidation, such as application of a polymeric coating to the metal layer surface prior to CMP. In general, the present techniques apply to treatment of the metal surface, such as by hardening of the metal surface, to increase abrasion resistance and/or chemical resistance. Treatment occurs before CMP, and as a result, the amount of material removed during the subsequent CMP, the related thickness-to-planarity, and dishing may be reduced.

With a lower thickness-to-planarity and less metal removed, less metal may be deposited initially before CMP and less waste is generated during CMP. Additionally, the dishing phenomenon that unfortunately causes, for example, cavities on the wafer surface may be reduced. Dishing is to be avoided because the resulting topology, for example, may cause damage to the underlying topology during subsequent processing of the semiconductor wafer. It should be noted that in contrast with the present techniques, CMP slurries that oxidize the metal surface during CMP, deposit only a thin oxide layer and do not significantly reduce dishing or thickness-to-planarity.

Turning now to the drawings, and referring initially to FIG. 1, a cross-sectional view of a portion of a semiconductor wafer 10 having a substrate 12, interlayer dielectric (ILD) layer 14, and contact 16, is illustrated. The substrate 12 is typically a semiconductor substrate or wafer, such as silicon or gallium arsenide, upon which conductive interfaces or structures may be formed. A metal layer (not shown), such as aluminum, copper, tungsten, and/or titanium, or some other conductive layer, such as polysilicon, may be deposited on the substrate 12 underneath the ILD layer 14. Furthermore, additional ILD material (not shown) may be deposited between the substrate 12 and ILD layer 14. In general, interlayer dielectrics, such as ILD layer 14, may be used to separate and insulate wafer conductive layers, and can be, for example, a deposited silicon oxide, silicon nitride, or a polyimide film.

Contact 16 represents conductive material and is, for example, an active structure of a lower conductive layer or an interconnecting metal line from a lower conductive layer. A "contact opening" 18 (or "via") is formed in the ILD layer 14, exposing an underlying conductive surface 19, of an active region or conductive layer. Although in this illustrative embodiment, the exposed conductive region 19 is generically shown as a surface of the contact 16, those of ordinary skill in the art recognize that many different types of conductive regions 19 may exist at various locations along the interface between layers 12 and 14.

After the contact opening 18 is formed, another conductive layer may then be deposited onto the wafer 10, forming a metal "contact plug" in the contact opening 18 so that the new metal layer is connected to the underlying contact 16. For example, referring now to FIG. 2, a cross-sectional view of the semiconductor wafer 10 illustrated in FIG. 1, having a conductive layer, such as metal layer 20, with a recessed region 22 that forms as the metal is deposited. The metal layer 20 may be, for example, aluminum, copper, tungsten, titanium, a combination thereof, and so forth. After deposition, the metal layer 20 may be subjected to chemical mechanical planarization (CMP) to remove excess material and to smooth (planarize) the surface. For CMP, planarization results from the difference in the material removal rate between the elevated region 23 and the recessed region 22 due to the difference in the pressure experienced by the two regions.

A problem in CMP is that significant material is removed in the recessed regions, such as in the recessed region 22, because the CMP slurry etches the recessed region 22 even though the CMP pad may not touch the recessed region 22. Thus, more material of the metal layer 20 must be removed to achieve planarity. More waste is generated because more metal must be deposited initially to accommodate the significant amount of metal removed during CMP. The thickness 24 is the height of the metal layer 20 before CMP. Thickness-to-planarity 26 is the amount of material removed during CMP from the elevated region 23 in order for the surface to become planar. The height or level on the metal layer 20 at which the surface becomes generally planar is denoted by reference numeral 27. As will be appreciated by those of ordinary skill in the art, the level 27 at which the surface becomes planar may be different than the ultimate stopping layer on the field. For example, after the surface becomes planar (i.e., at level 27), the wafer 10 may then be subjected to additional processing, such as a CMP overpolish step which removes additional material from metal layer 20. In this illustrative example, the stopping layer on the field is denoted by reference numeral 28 and is the top of the ILD layer 14. In certain applications for copper CMP, an overpolish step with partial or complete copper removal across the wafer may be required. Copper dishing may occur both during the planarization CMP and during the overpolish CMP.

As previously mentioned, the CMP slurry may undesirably attack the material in the recessed region 22 which may descend to below the CMP stopping layer 28 on the field. Significant material removal may occur in the metal contact plug 30 down in the trench (contact hole 18). The amount of "dishing" (see FIGS. 3 and 5) is the distance between the CMP stopping layer 28 and the etched material down in the contact plug 30. It should be noted that the representations in FIGS. 2 and 3 do not use the present techniques but are illustrated to demonstrate the merits of present techniques.

Figure 3:
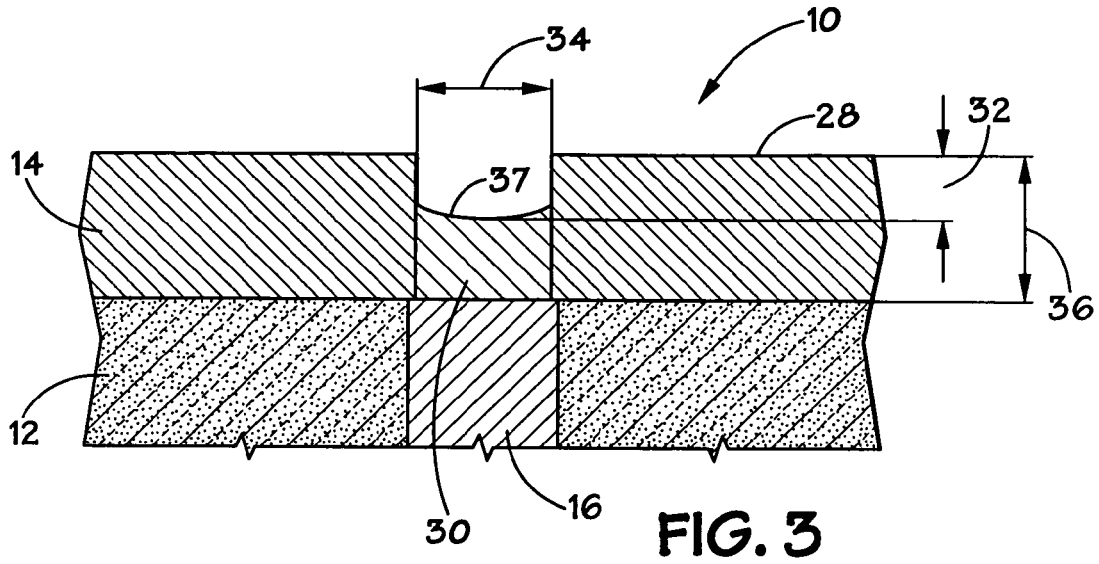
FIG. 3 illustrates a cross-sectional view of the semiconductor wafer in FIG. 2 after CMP of the metal layer.

FIG. 3 depicts the cross-sectional view of the semiconductor wafer 10 after subjecting the metal layer 20 to CMP for both planarization and subsequent overpolish. The contact plug 30 is shown with a dishing dimension 32. In this illustrative example, the metal layer 20 has been removed from the surface of the ILD layer 14. The dishing dimension 32 is the distance between the stopping layer 28 and the surface 37 of the contact plug 30. In one example, the contact plug 30 is copper, the width 34 of the contact plug is approximately 100 microns, the height 36 is about 5,500 angstroms, and the dishing dimension 32 is about 1000 angstroms.

Figure 2:
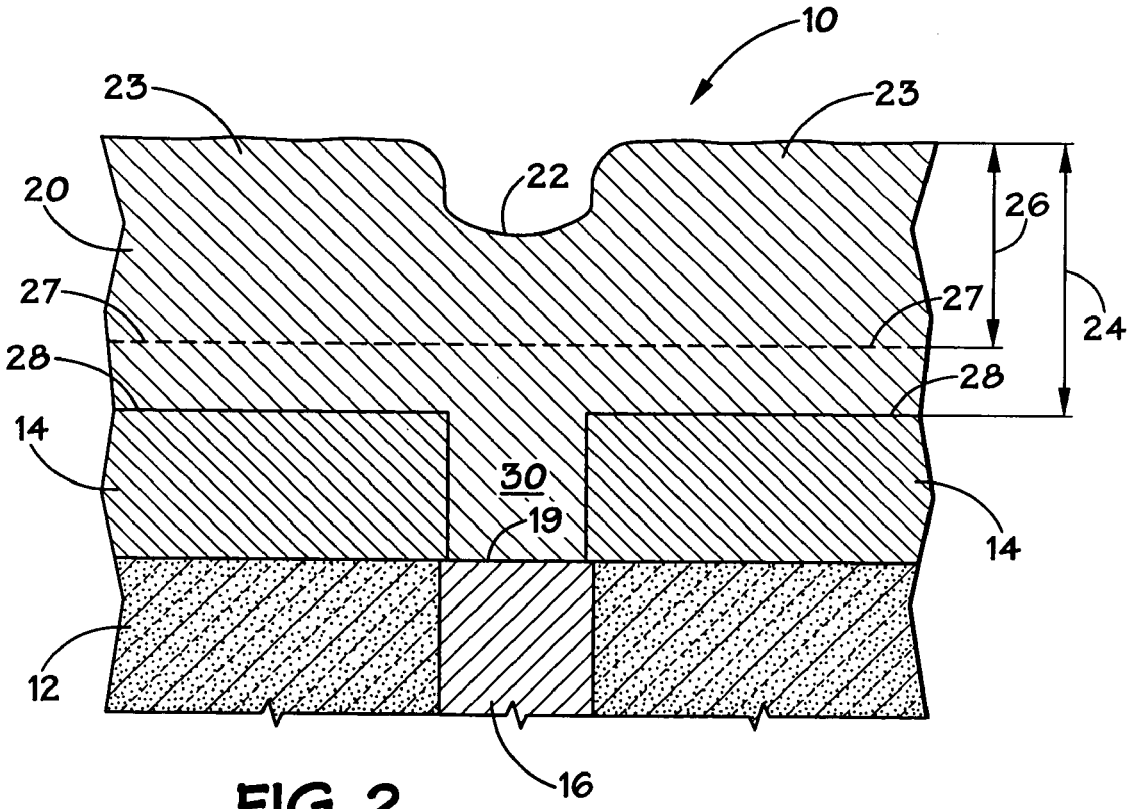
FIG. 2 illustrates a cross-sectional view of the semiconductor wafer in FIG. 1, having an exemplary metal layer surface.

Embodiments of the presently claimed techniques reduce dishing. In the above example, oxidation of the metal layer 20 surface before CMP reduces the dishing dimension 32 from approximately 1000 angstroms to within 400-500 angstroms. In certain circumstances, the dishing dimension 32 may be reduced to as low as 250 angstroms. In yet another example of oxidation of a copper layer, the dishing dimension 32 is reduced from about 780 angstroms to about 280 angstroms. In general, the dishing dimension 32 with the present techniques may be reduced by 50-75%. In contrast, slurries that oxidize the metal surface during CMP deposit only a thin oxide layer and do not significantly reduce dishing or thickness-to-planarity 26 (FIG. 2).

Dishing and thickness-to-planarity are reduced by forming an oxide layer of desired thickness and density on the metal surface before CMP. Due to the presence of the oxide layer, the metal surface becomes hardened and thus more resistant to abrasion by the CMP pad and/or more resistant to attack by the CMP slurry. It should be noted that the present techniques apply to any oxidizable metal subjected to CMP. Furthermore, existing portions of the wafer fabrication system may be used to create the oxide layer. For example, the oxide layer may be formed during an annealing process that precedes CMP of the metal layer.

In an example of a copper metal layer 20', a copper oxide layer is formed before copper CMP is performed. By introducing an oxidant, such as $O_2$ or $O_3$ gas (diatomic or triatomic oxygen), towards the end of an annealing cycle, it is possible to oxidize the copper surface to the desired thickness before CMP. As will be appreciated by those of ordinary skill in the art, it is typical to anneal copper after plating or deposition to increase the conductivity of copper. In contrast, other metals, such as aluminum, may normally possess adequate conductivity without annealing. Moreover, metal layers may be dry etched instead of subjected to CMP. Nevertheless, the presently claimed techniques may be applicable to any oxidizable metal that is removed from the wafer.

Figure 4:
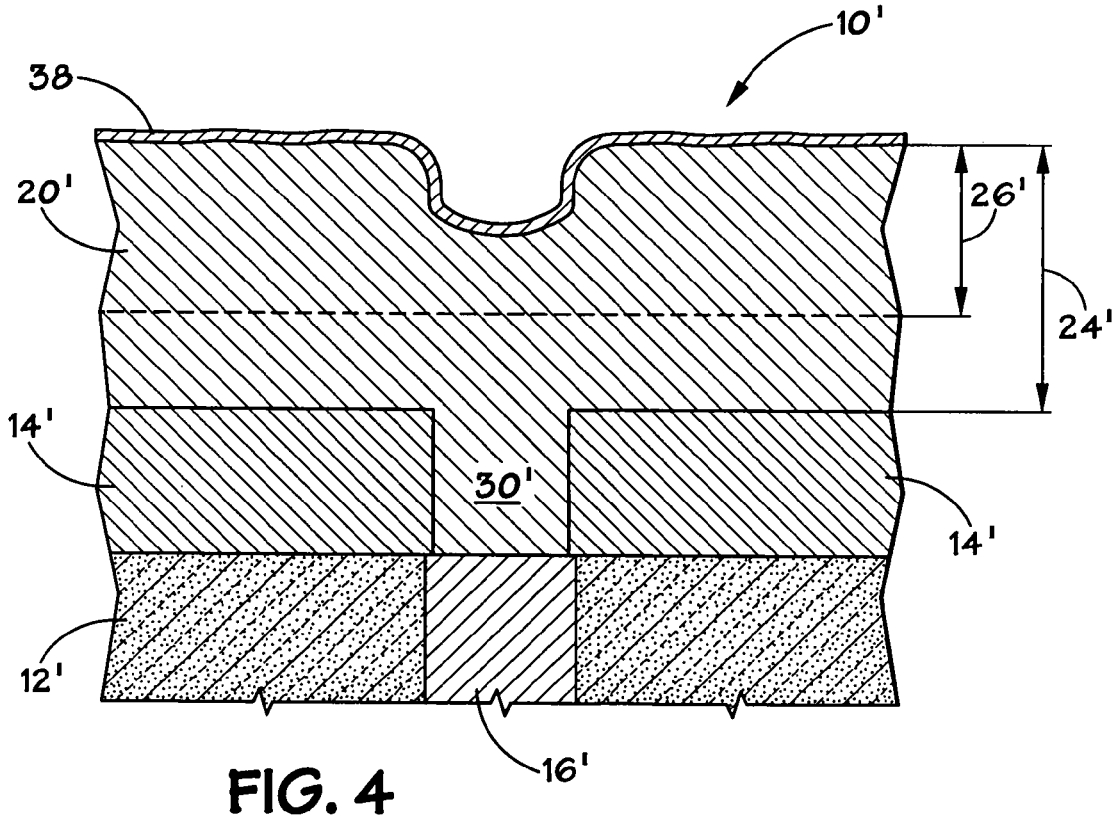
FIG. 4 illustrates a cross-sectional view of the semiconductor wafer in FIG. 2 before CMP and having a metal oxide layer of desired thickness and density in accordance with embodiments of the presently claimed techniques.

Referring now to FIG. 4, a cross-sectional view of the semiconductor wafer 10' after annealing but before CMP and having a metal oxide layer 38 of desired thickness and density, is illustrated. In this illustrative embodiment, the metal layer 20 is copper and the oxide layer 38 is copper oxide. Annealing may be performed at high temperature, such as in the range of 150-250° C., and thus, the resulting oxide layer is especially dense. By forming a relatively thick (e.g., 300 to 600 angstroms) and dense oxide layer, it is possible, during the subsequent CMP, to decrease the material removal rate in the recessed regions and thus minimize dishing and thickness-to-planarity.

For a metal layer 20 that is that is a conformal copper coating (i.e., plating), the required thickness 24' of copper layer 20' may, for example, be reduced from 11,000 to 7,000 angstroms because the presence of the relatively thick and dense copper oxide layer 38 results in a reduction of the thickness-to-planarity 26', for example, from 10,000 to 6,000 angstroms. The thickness-to-planarity 26' is the height of the metal layer 20' removed during CMP to achieve planarity. Techniques that reduce dishing and thickness-to-planarity require less thickness 24' of metal layer 20'. Less material is deposited and less material is removed.

Figure 5:
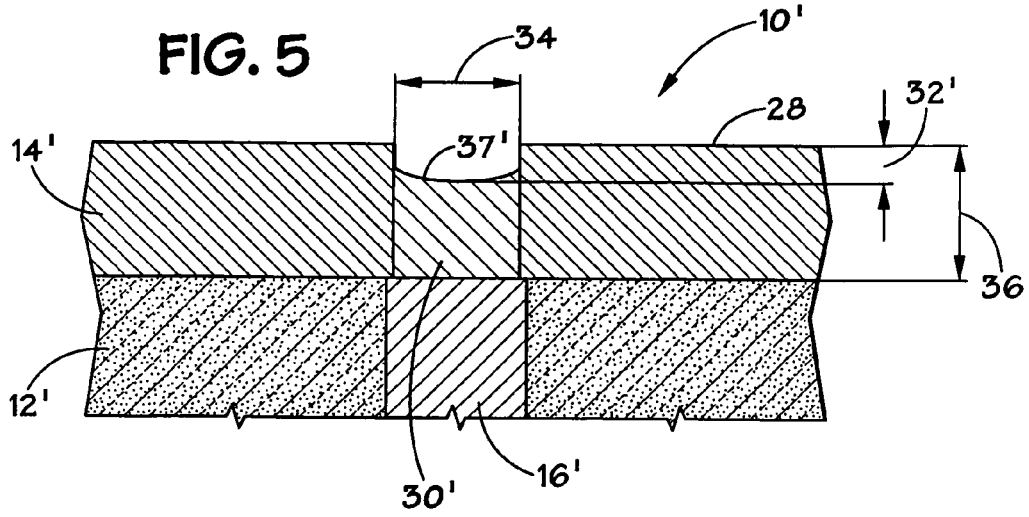
FIG. 5 illustrates a cross-sectional view of the semiconductor wafer in FIG. 4 after CMP of the metal layer in accordance with aspects of the presently claimed techniques.

Referring to FIG. 5, a cross-sectional view of the semiconductor wafer 10' in FIG. 4 after CMP of the metal layer 20' in accordance with aspects of the presently claimed techniques is depicted. As mentioned in the discussion of FIG. 4, the wafer metal surface (layer 20' in FIG. 4) is oxidized in an annealing process prior to CMP. And as with the wafer 10 of FIG. 3, this oxidized wafer 10' is subjected to CMP for both planarization and a subsequent overpolish. In this example, the metal (copper) layer 20 is ultimately removed from surface of the ILD layer 14', and the surface of the ILD layer 14' is the stopping layer 28'. Furthermore, the contact plug 30' is shown with a reduced dishing dimension 32', in this example, reduced from 1000 angstroms to 450 angstroms. Contact plug 30' has the same width 34 (100 microns) and height 36 (angstroms) as that depicted in FIG. 3.

Embodiments of the presently claimed technique apply to CMP of oxidizable metal layers in a variety of wafer configurations. Implementations apply to contact plugs, and to a variety of filled or plated volumes on a semiconductor wafer. Additionally, exposed regions may be active or not active, and if active, may be, for example, a doped region, interconnecting metal line, or the like. In general, embodiments of the presently claimed approach apply to removal or modification, such as via CMP, of oxidizable metals.

One of the advantages of the presently claimed techniques is that the lower thickness-to-planarity translates into lower metal plating thickness, thus saving manufacturing costs. Additionally, metals, such as copper, removed during CMP, normally cannot be reclaimed. As a result, the metal removed may be waste and may require treatment to become inert. Accordingly, embodiments of the present techniques reduce waste generation, the associated waste treatment and disposal costs, and facilitate compliance with EPA requirements and other waste disposal regulations. In general, as previously indicated, the amount of metal deposited and removed is reduced by about 50-75%.

Figure 6:
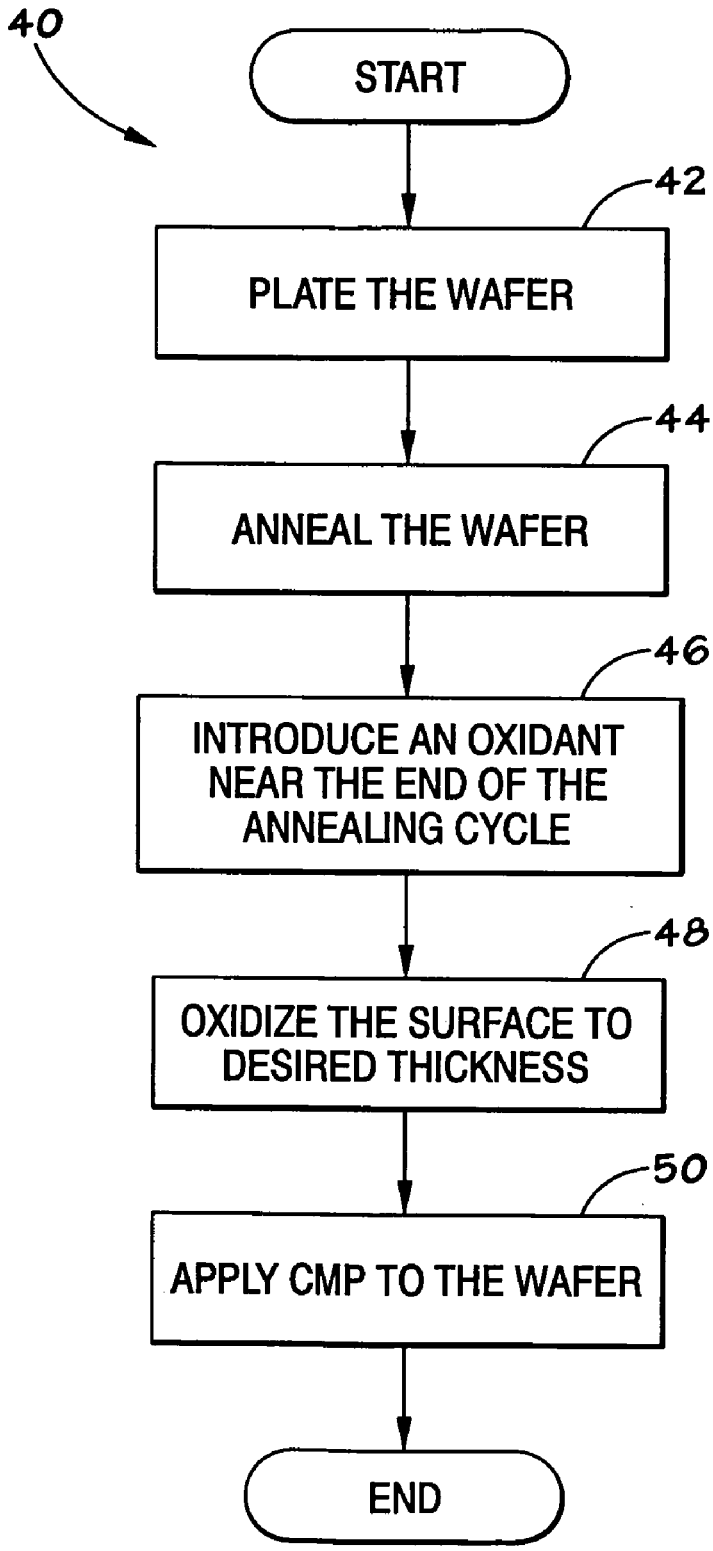
FIG. 6 illustrates a block diagram of an exemplary oxidizing technique in accordance with the presently claimed techniques used to minimize thickness-to-planarity and dishing in CMP.

Referring now to FIG. 6, a block diagram of an oxidizing technique 40 used to minimize thickness-to-planarity and dishing in CMP, is illustrated. A metal layer, such as copper, is deposited on a semiconductor wafer (block 42). The wafer is annealed (baked), for example, in a temperature chamber or other thermal unit in the range of 150-250° C. (e.g., 200° C.) for 15-60 minutes (e.g., 30 minutes), as represented by block 44. An oxide layer is formed by introducing an oxidant into the temperature chamber (block 46). In one embodiment, the oxidant is introduced near the end of the annealing cycle (bake). For example, the oxidant, such as oxygen or ozone, may be introduced into the temperature chamber during the last 1-2 minutes of a 30 minute annealing cycle. In the case of a copper metal layer, a copper oxide layer is formed with a thickness in the range of 300 to 600 angstroms (block 48). In block 50, CMP is applied to the semiconductor wafer. The presence of the relatively thick and dense oxide layer on the semiconductor wafer results in improved thickness-to-planarity and dishing characteristics.

It should be apparent that with the presently claimed techniques, the metal layer surface may be oxidized prior to CMP in a process other than an annealing process. For example, the metal layer may be oxidized after the semiconductor wafer has been annealed. Metal oxidation can be carried out using oxygen plasma or the residual heat in the wafer from the annealing process may be used in the oxidation. Or the wafer may be allowed to cool and then reheated before oxidation of the metal surface. In general, the techniques encompass a variety of approaches and devices to oxidize the semiconductor metal layer prior to CMP under heat, including the use of residual heat, with an oxidizing agent, such as oxygen.

It should also be noted that in this illustrative embodiment, oxidation is given only as an example. Techniques other than oxidation, such as the use of a polymeric coating, may be employed to harden the metal surface before CMP, and thus to make the metal surface more resistant to abrasion and/or chemical attack.

Figure 7:
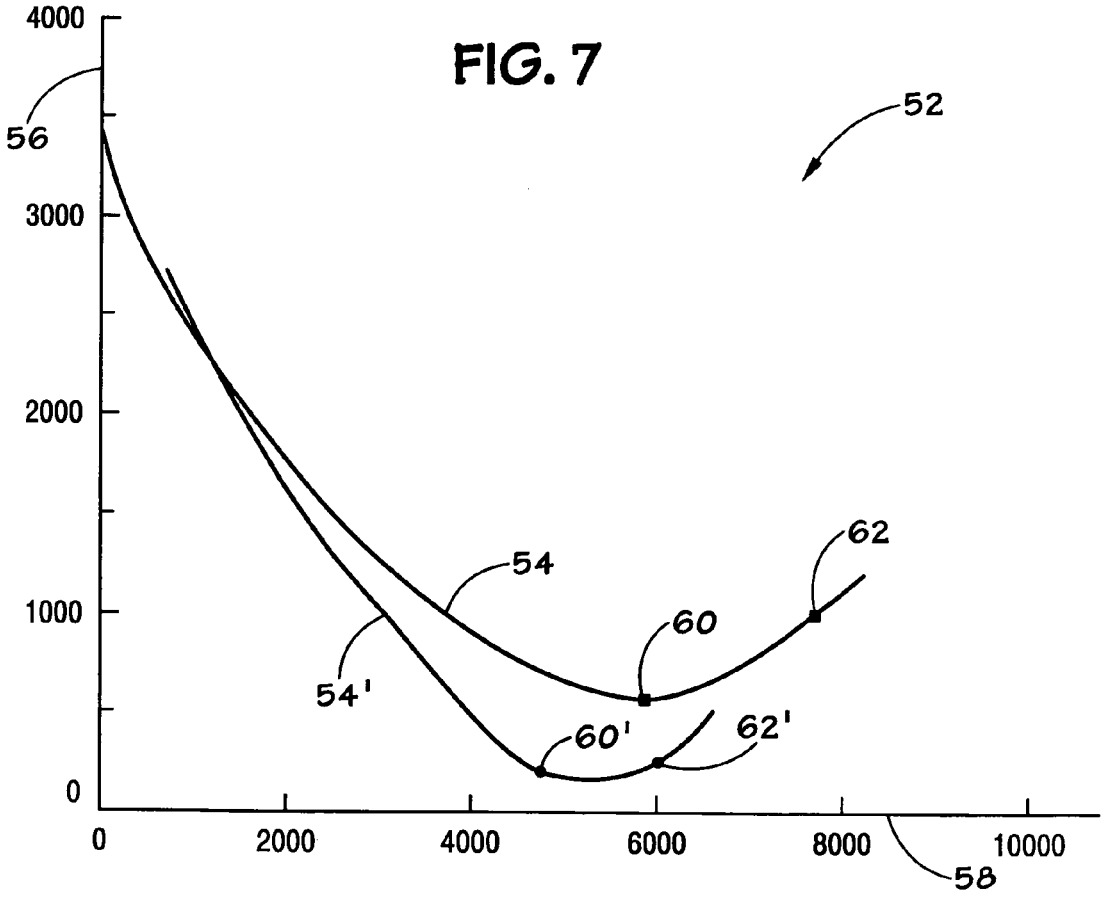
FIG. 7 illustrates two representative curves of dishing versus thickness-to-planarity after CMP of a wafer metal layer without an oxidized surface and of a wafer metal layer with an oxidized surface in accordance with aspects of the presently claimed techniques.

Referring now to FIG. 7, a plot 52 of two representative curves 54 and 54' of dishing 56 in angstroms versus material removed 58 in angstroms for a non-hardened (e.g., non-oxidized) wafer metal layer 20 and for an hardened (e.g., oxidized) metal layer 20', is depicted. The depths of the recessed regions (i.e., dishing 56) decrease in both cases during the initial portion of the CMP as material is preferentially removed from the elevated regions. Though both cases show a decrease in dishing 56 as the surface is planarized, the planarization is more effective with the oxidized metal layer 20' than with the non-oxidized metal layer 20.

The points at which the metal layers 20 and 20' become planarized are denoted by reference numeral 60 for the non-oxidized case and reference numeral 60' for the oxidized case. The thickness-to-planarity may be defined as the value of the material removed 58 at these planarization points. As indicated by these points 60 and 60', the material removed 58 (thickness-to-planarity) from the metal layer to achieve the specified degree of planarity (e.g., measured with optical sensors) is reduced from 7800 angstroms to 4800 angstroms. Furthermore, the end points at the conclusion of the CMP overpolish are denoted by reference numerals 62 and 62', respectively. In this exemplary representation, the dishing 56 in the contact plug is reduced from 1000 angstroms for a non-modified metal surface layer to 250 angstroms for a modified metal surface layer.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A semiconductor wafer comprising:

a substrate;

a via exposing a contact surface; and a hardened metal layer disposed above the substrate and the via, wherein the hardened layer substantially resists chemical attack during a chemical mechanical polishing of the wafer to provide reduced dishing, the hardened metal layer having a thickness of approximately 300 to 600 angstroms wherein the hardened metal layer is formed entirely on the surface of a metal layer disposed above the substrate and the contact surface.

2. The semiconductor wafer, as set forth in claim 1, wherein the hardened metal layer substantially resists abrasion.

3. The semiconductor wafer, as set forth in claim 1, wherein the hardened metal layer comprises a polymer coating.

4. The semiconductor wafer, as set forth in claim 1, wherein the portion of the metal layer above a stopping layer is approximately 7000 angstroms.

5. The semiconductor wafer, as set forth in claim 4, wherein the metal layer thickness-to-planarity is approximately 6000 angstroms.

6. The semiconductor wafer, as set forth in claim 4, wherein the metal layer comprises copper.

7. The semiconductor wafer, as set forth in claim 5, wherein the metal layer comprises tungsten.

8. The semiconductor wafer, as set forth in claim 1, wherein the hardened metal layer comprises an oxidized metal.

9. The semiconductor wafer, as set forth in claim 8, wherein the oxidized Metal comprises copper oxide.

10. The semiconductor wafer, as set forth in claim 8, wherein the oxidized metal comprises tungsten oxide.

11. The semiconductor wafer, as set forth in claim 8, wherein the oxidized metal is produced by annealing the semiconductor wafer in the presence of an oxidant.

12. The semiconductor wafer, as set forth in claim 11, wherein the oxidant comprises oxygen.

13. The semiconductor wafer, as set forth in claim 11, wherein the oxidant comprises ozone.

14. A semiconductor wafer comprising:

a substrate;

a contact plug disposed above the substrate;

a stopping layer, wherein a top surface of the contact plug and the surface of the stopping layer are separated by a dishing dimension of approximately 250 to 500 angstroms a hardened metal layer disposed entirely on a surface of a metal layer above the substrate and the plug, the hardened metal layer having a thickness of approximately 300 to 600 angstroms, and wherein the stopping layer is produced by chemical mechanical polishing to provide reduced dishing.

15. The semiconductor wafer, as set forth in claim 14, wherein the dishing dimension is approximately 4.5% to 9.1% of the height of the contact plug.

* * * * *